United States Patent [19]

Johansson

[11] 4,246,701

[45] Jan. 27, 1981

[54] SAFETY BRAKING DEVICE FOR A PORTABLE POWER SAW

[75] Inventor: Rolf A. G. Johansson, Unnaryd, Sweden

[73] Assignee: Jonsereds AB, Sweden

[21] Appl. No.: 38,915

[22] Filed: May 14, 1979

[30] Foreign Application Priority Data

May 18, 1978 [SE] Sweden ..... 7805690

[51] Int. Cl.[3] ..... B27B 17/00

[52] U.S. Cl. ..... 30/382

[58] Field of Search ..... 30/381, 382, 383

[56] References Cited

U.S. PATENT DOCUMENTS

| | | | |
|---|---|---|---|
| 3,739,475 | 1/1973 | Moore | 30/383 |
| 3,776,331 | 12/1973 | Gustafsson | 30/382 X |
| 3,934,345 | 1/1976 | Hirschkoff | 30/383 X |
| 3,991,469 | 11/1976 | Frederickson | 30/381 |
| 4,057,900 | 11/1977 | Nagy | 30/382 |
| 4,059,895 | 11/1977 | Hirschkoff | 30/382 |
| 4,091,896 | 5/1978 | Wieland | 30/382 |
| 4,121,339 | 10/1978 | Nikolich | 30/381 |
| 4,197,640 | 4/1980 | Murray | 30/382 |

*Primary Examiner*—Jimmy C. Peters
*Attorney, Agent, or Firm*—Holman & Stern

[57] ABSTRACT

A safety brake for a power saw comprises mainly a brake element arranged to stop the cutter chain when actuated by an actuating member acted upon by a control handle arranged to be automatically operated when the saw operator is beginning to lose control over the saw, whereby the saw will begin to swing upwards against the operator. The actuating member being arranged to form an angle against said control handle and being formed as an oblong flat structure guided to be movable between an inactive position, occupied when the saw operates normally and to an active position for effecting a brake effect on the cutter chain when the saw begins to move uncontrollable. A spring being arranged to retain the actuating member in inactive position by urging it in engagement with a latch, whereas same spring is adapted to effect a positive movement of the actuating member to its active position when it is unlatched by the manual influence from the control handle.

20 Claims, 6 Drawing Figures

SAFETY BRAKING DEVICE FOR A PORTABLE POWER SAW

BACKGROUND OF THE INVENTION

The present invention refers to a safety braking device for a portable power saw, particularly a chain saw, of the type incorporating a rotatable brake drum coupled to the drive shaft of the power saw, a flexible brake element disposed about at least a part of said brake drum, and a control handle which cooperates with an actuating member, retained in operating position against the action of a spring and which is releasable by influence of the control handle for actuation of the brake.

Safety brake devices for power saws are arranged in such a manner that the accident risk at so called kickbacks of the power saw is reduced to a minimum. Safety brakes are earlier known and consist mainly of at least one brake drum coupled to the engine drive shaft, a moveably arranged control handle located in front of the gripping handle of the power saw, and being connected direct or via one or more actuation members to a brake element. The brake element is acted upon by one or more springs, whereby the control handle and the brake element are brought to take up their inactive position, at which the brake element is free from said drum. The control handle is arranged thus that the power saw when subjected e.g. to a so called kickback during operation the manual influence unintentionally caused by the saw operator on the control handle will result in a displacement thereof, whereby a biased spring force is released and urges the brake element to engagement against the brake drum rotating in the power saw. It is then generated a braking power, which is sufficient swiftly to retard the brake drum and the saw chain, whereby serious near-accidents are avoided. The drawbacks of the hitherto known safety brake devices are that they incorporate a plurality of components which have to be manufactured with more or less accuracy e.g. such as bearings, latchs etc, whereby the assembly and the manufacture will be expensive. In all cases it is used some type of a lever which can be swung about one or more pivots, and it is therefore necessary to dimension all the details forming part of the assembly comparatively coarse as they will be subjected to heavy stresses at braking. This will on one hand make the manufacture more expensive and it will on the other hand result in a more heavy power saw. A known fact is that the more details that are forming part of a mechanism the bigger is the risk for malfunctions and variations on the braking effect. As the safety brake device is an important safety arrangement on a power saw is it necessary that its function is very reliable. This is secured with a simple design with only a few components.

SUMMARY OF THE INVENTION

The purpose of the present invention is to provide a safety brake device which is reliable, very simple and therefore cheap in manufacture and which has a low weight. This is solved with the invention thereby that the actuating member is designed as an oblong, flat sheet metal member having one first end connected to the control handle under an angle, the actuating member being adapted to cooperate with at least one first guide, designed to allow a certain degree of displacement of the actuating member in its longitudinal direction and also to make possible a pivoting movement, whereby its second end, turned away from the control handle, is pivotable from said operating position, in which the actuating member is detained by a spring due to cooperation between at least a second guide and a latch and to a release position in which the actuating member is displaced by the spring during simultaneous tightening of the brake element about the brake drum.

BRIEF DESCRIPTION OF THE DRAWINGS

The invention will hereinafter be further described with reference to the accompanying drawings.

DESCRIPTION OF SOME PREFERRED EMBODIMENTS

Figure 1:
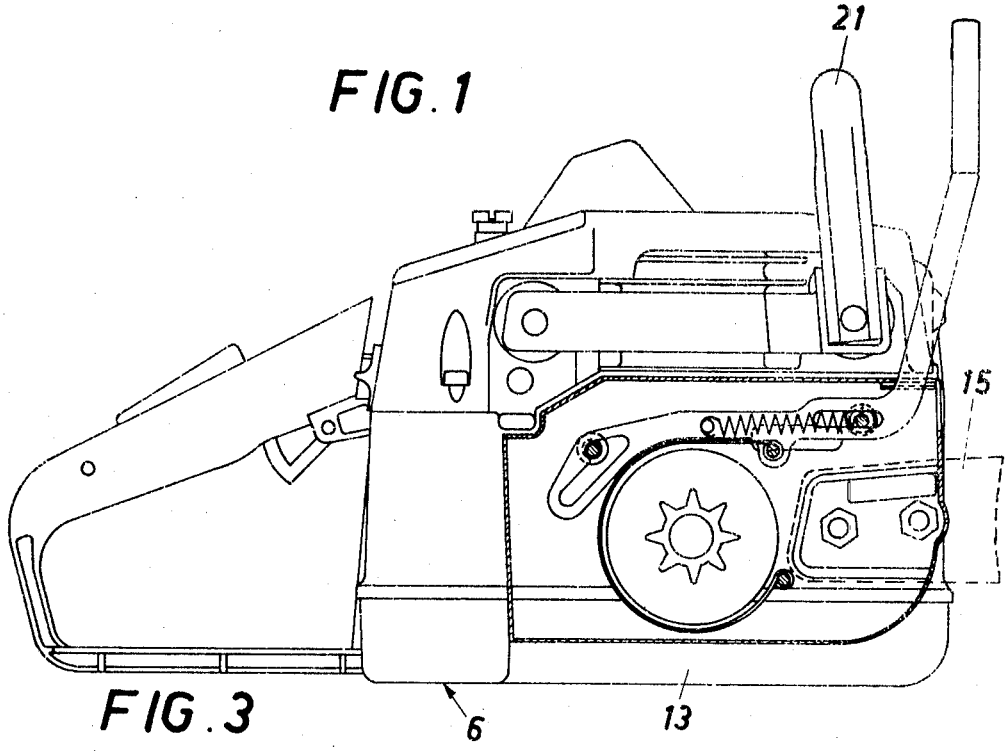
FIG. 1 shows a side elevation of a power saw, whereby a section has been laid through the chain guard for showing the safety brake in inactive position.

The safety brake 1 consists in the embodiment shown in FIG. 1 mainly of three parts, i.e. a brake arm 2, a spring 3 and a brake band 4, which are all preferably mounted in the chain guard 5 of the power saw 6, and which chain guard may be made of plastic material or another mouldable material. The brake arm 2 comprises a control handle 7 and an actuating member 8 which are interconnected under an angle. They can of course also be made in one single piece. The mainly oblong actuating member 8 is preferably made from sheet metal, whereby a flat, space-saving and light design is obtained. The actuating member 8 is furthermore displaceable in its longitudinal direction and it is guided with aid of guides such as studs 9,10 mounted in or premoulded in the chain guard 5. The studs 9, 10 pass through oblong grooves 11, 12 in the actuating member 8, whereby this can be moved to a limited extent. The studs 9, 10 will also detain the actuating member 8 at the chain guard 5, whereby the actuating member 8 is prevented from slipping off the studs 9, 10 when the chain guard 5 has been mounted on the power saw 6, as the end surfaces of the studs 9, 10 will rest against the power saw 6 structure. The studs 9, 10 can alternatively be turned in steel and be pressed into precast holes in the chain guard 5. Locking washers (not shown) are then preferably arranged at the outer ends of the studs 9, 10 for detaining the actuating member 8.

The spring 3 has one of its ends coupled to the actuating member 8 and its other end is anchored to a fixed part at the power saw chain guard 5, e.g. the guide 10 in such a manner that the spring 3 exerts a force on the actuating member 8 which is directed mainly against the connection between the control handle 7 and the actuating member 8. The guide groove 11 is provided with a widened portion forming a latch 16 adapted to allow a guide 9 to engage the latch 16 under influence of the spring 3 at manual displacement of the control handle 7 and the actuating member 8 backwards (away from the cutter bar 15) and thereby to bias the actuating member 8 in a stable, inactive operation position. A brake element in the form of a flexible brake band 4 has one end connected to the actuating member 8 between the guides 9, 10 and its other end anchored to the chain guard 5 of the power saw 6.

The brake band 4 thus extends between its two ends entirely or partly circular about a brake drum 20 cooperating with the drive shaft 19 of the power saw 6. When the guide 9 is in engagement with the latch 16 and the actuating member 8 and the control handle 7 thus are located in their rear, inactive position the brake drum 20 is free to rotate independent of the brake band 4. The brake band 4 thereby forms a broken circle of somewhat bigger radius than the outer radius of the brake drum 20. When the power saw 6 by an extern influence is exerted to a sufficiently violent or sudden movement the saw operator's hand grip on the gripping handle 21 of the power saw is unintendedly altered whereby the control handle 7 will be moved from its normal inactive position (see FIG. 1). The control handle 7 is thereby pushed forward/downward against the cutter bar, which has to result that the rearmost part of the actuating member 8, i.e. the portion of the guide groove 11 provided with the latch 16, during action of the spring 3 will be pivoted upwards about the guide 10. The biased spring force will thereby be released and the actuating member 8 will hereby be displaced mainly in forward direction. The upper end of the brake band will simultaneously be displaced in forward direction until the brake band 4 engages the brake drum 20, whereby the desired braking action is obtained. When the safety brake 1 shall be reset to its normal inactive position the control handle 7 and the actuating member 8 is displaced manually rearwards in direction away from the cutter bar so far that the guide 9 will engage the latch 16 in the guide groove 11.

Figure 3:
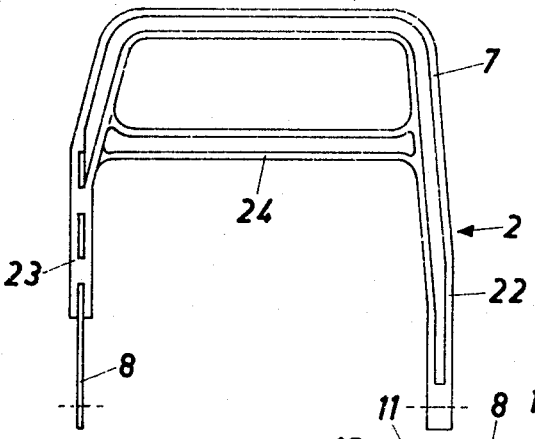
FIG. 3 shows the control handle from its front side.

FIG. 3 shows the braking arm 2 with the control handle 7 and the actuating member 8 in front elevation and it can here be seen that a supporting handle 24 is arranged between the vertical shanks 22, 23 of the control handle. The task of this supporting handle 24 is to support the braking arm 2 thus that this for the purpose of obtaining a low weight safety brake device can be made with less material thickness e.g. from plastic material.

In an alternative embodiment of the control handle 7 there is arranged a spring-actuated link (not shown) between the upper and lower parts of the control handle 7 to allow the upper part of the control handle 7 to be folded against the gripping handle 21 of the power saw 6.

Figure 2:
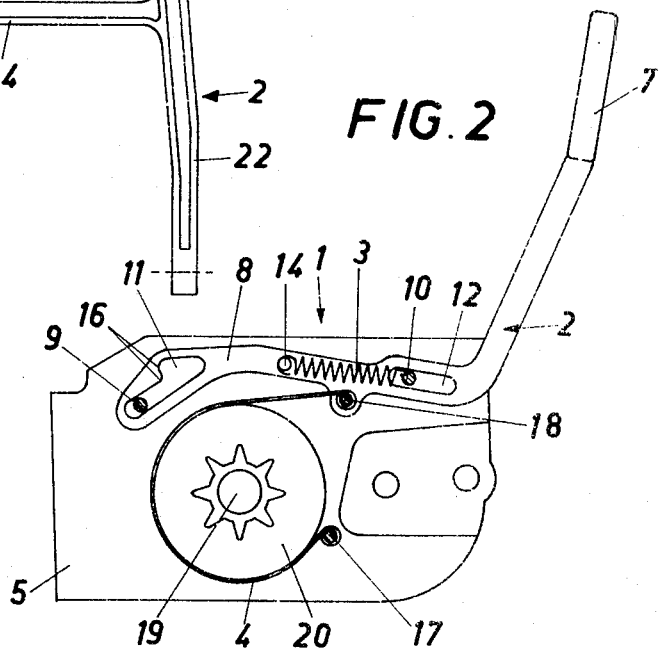
FIG. 2 shows the safety brake in its active position.
Figure 4:
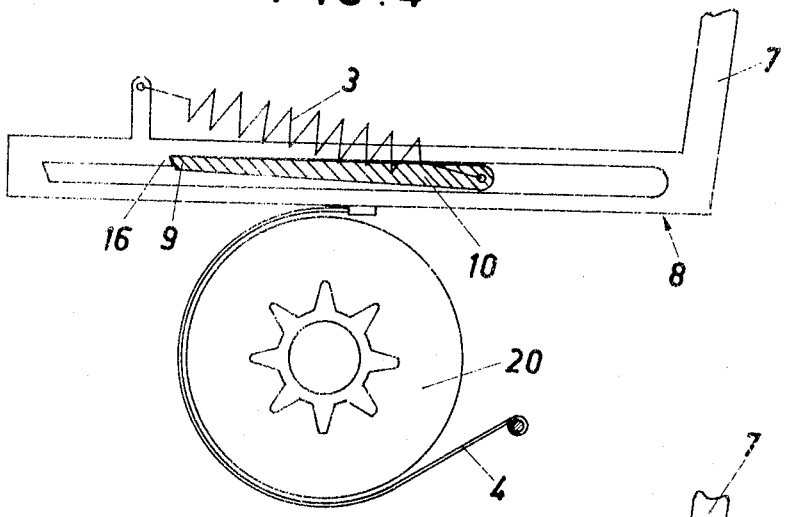
FIG. 4 shows in a schematic fashion an alternative embodiment of a safety brake having only one guide member.
Figure 5:
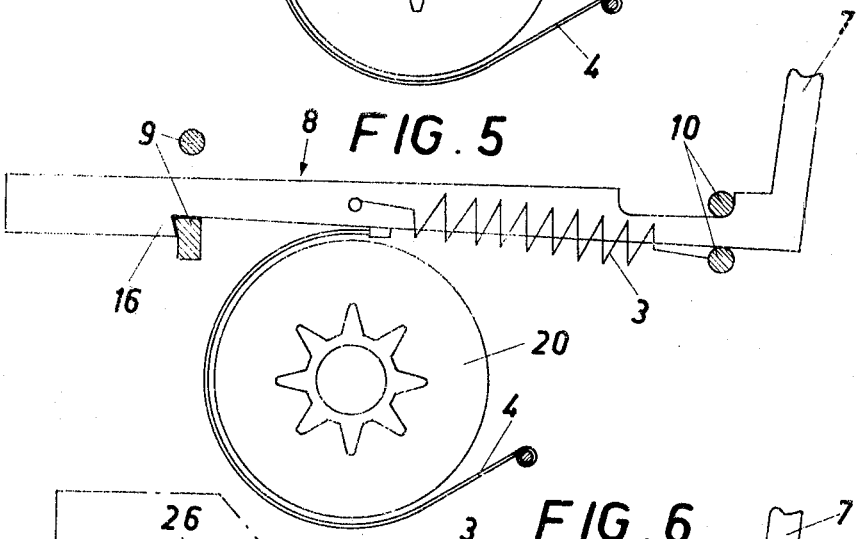
FIG. 5 shows a further embodiment of a safety brake having a plurality of guides.
Figure 6:
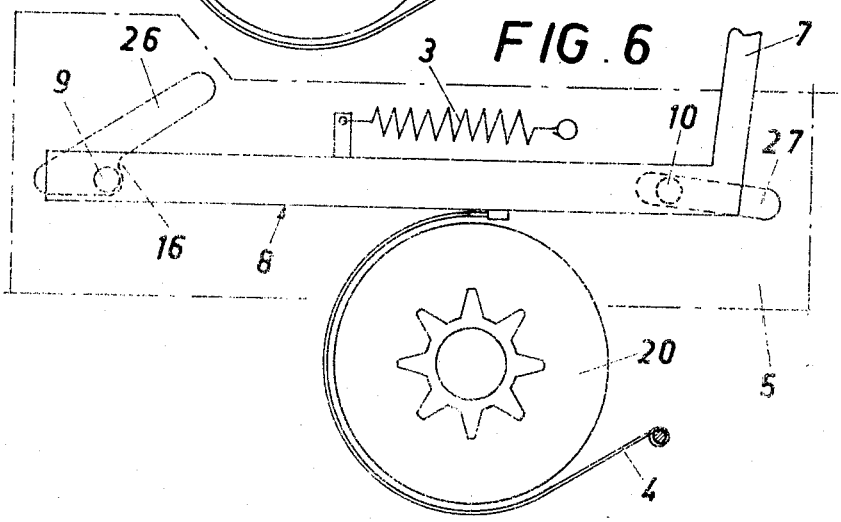
FIG. 6 shows a fourth embodiment of a safety brake provided with two guides.

FIGS. 4, 5 and 6 show alternative embodiments within the scope of the invention, whereby the grooves 11, 12 in the actuating member 8 have been eliminated. The guides 9, 10 can then be located above and below the actuating member 8. The guides can also be designed as channels or grooves 26, 27 provided in the chain guard 5 or in the power saw 6 frame 13 and in which channels or grooves 26, 27 the actuating member 8 is moveable to a certain degree on studs 9, 10 arranged thereon in a manner corresponding to that in the embodiment according to FIGS. 1 to 3. As shown in FIG. 4 it is possible to use a single guide member 9, 10 for achieving a reliable safety brake according to the invention.

What I claim is:

1. A safety braking device for a portable power saw, particularly a chain saw of the type incorporating a brake drum coupled to the drive shaft of the power saw, a flexible brake element disposed about at least a part of said brake drum, and a control handle, which cooperates with an actuating member, retained in operating position against the action of a spring and which is releasable by influence of the control handle for actuation of the brake, characterized thereby, that the actuating member is designed as an oblong, flat sheet metal member having one first end connected to the control handle under an angle, the actuating member being adapted to cooperate with at least one first guide designed to allow a certain degree of displacement of the actuating member in its longitudinal direction and also to make possible a pivoting movement, whereby its second end, turned away from the control handle, is pivotable from said operating position, in which the actuating member is detained by a spring due to cooperation between at least a second guide and a latch and to a release position in which the actuating member is displaced by the spring during simultaneous tightening of the brake element about the brake drum.

2. A safety braking device according to claim 1, wherein said the brake element is designed as a flexible brake band.

3. A safety braking device according to claim 1 or 2, wherein said control handle is made integral with said actuating member.

4. A safety braking device according to claim 1 or 2, wherein said control handle is designed with at least one spring-actuated link by means of which the upper part of said control handle manually can be brought into at least two different angular positions relative to the actuating member.

5. A safety braking device according to claim 3 wherein one end of said brake element is connected to said actuating member, whereas its other end is anchored to a portion of the power saw frame or casing.

6. A safety braking device according to claim 5 wherein said actuating member is provided with at least one guide groove.

7. A safety braking device according to claim 6 wherein said actuating member is urged by at least one spring to take up one of two stable positions.

8. A safety braking device according to claim 7 wherein said spring provided to act upon said actuating member is arranged to cooperate with the releasing force manually exerted upon the control handle.

9. A safety braking device according to claim 8 wherein said spring acting upon actuating member has one of its ends connected to the power saw frame or casing via a guide.

10. A safety braking device according to claim 9 wherein at least one guiding groove is provided with a widened portion forming a latch.

11. A safety braking device according to claim 10 wherein said guides are formed by studs arranged in the chain guard and/or frame of the power saw.

12. A safety braking device according to claim 11 wherein all elements forming part of the safety braking device are connected to or formed integral with the chain guard of the power saw.

13. A safety braking device according to claim 4, wherein one end of said brake element is connected to said actuating member, whereas its other end is anchored to a portion of the power saw frame or casing.

14. A safety braking device according to claim 4, wherein said actuating member is provided with at least one guide groove.

15. A safety braking device according to claim 4, wherein said actuating member is urged by at least one spring to take up one of two stable positions.

16. A safety braking device according to claim 15, wherein said spring provided to act upon said actuating member is arranged to cooperate with the releasing force manually exerted upon the control handle.

17. A safety braking device according to claim 16, wherein said spring acting upon said actuating member has one of its ends connected to the power saw frame or casing via a guide.

18. A safety braking device according to claim 14, wherein at least one guiding groove is provided with a widened portion forming a latch.

19. A safety braking device according to claim 17, wherein said guides are formed by studs arranged in the chain guard and/or frame of the power saw.

20. A safety braking device according to claim 4, wherein all elements forming part of the safety braking device are connected to or formed integral with the chain guard of the power saw.

* * * * *